United States Patent [19]

Johnson

[11] Patent Number: 4,546,419

[45] Date of Patent: Oct. 8, 1985

[54] WALL RECEPTACLE RECESSED BOX CONTAINED LIGHT INTENSITY ON/OFF CONTROLLED NIGHT LIGHT SYSTEM

[76] Inventor: Kelli J. Johnson, 318 Bluebonnet Trail, Garland, Tex. 75043

[21] Appl. No.: 668,145

[22] Filed: Nov. 5, 1984

[51] Int. Cl.[4] ..... F21V 33/00

[52] U.S. Cl. ..... 362/95; 200/310; 315/156

[58] Field of Search ..... 362/95, 147, 801; 200/310, 317; 315/149, 156

[56] References Cited

U.S. PATENT DOCUMENTS

| | | | |
|---|---|---|---|
| 2,189,676 | 2/1940 | Pfohl | 200/310 |
| 2,749,428 | 6/1956 | McCarthy | 362/95 |
| 3,061,716 | 10/1962 | Benander | 362/95 |
| 3,588,489 | 6/1971 | Gaines | 362/95 |
| 3,739,226 | 6/1973 | Seiter et al. | 315/156 |
| 3,895,225 | 7/1975 | Prior | 362/95 |
| 4,000,405 | 12/1976 | Horwinski | 362/95 |
| 4,016,450 | 4/1977 | Balekjian | 315/149 |
| 4,038,582 | 7/1977 | Horwinski | 362/95 |
| 4,255,780 | 3/1981 | Sakellaris | 362/95 |

*Primary Examiner*—Ira S. Lazarus

*Attorney, Agent, or Firm*—Warren H. Kintzinger

[57] ABSTRACT

A wall recessed receptacle box contained night light with a photocell light intensity dusk-dawn (or room illumination) on/off switch control equipped with manual dimming control for a darker/brighter night light atmosphere. The night light box is insertable in a recessed box in the wall otherwise used for a normal receptacle outlet and includes at least one plug in receptacle with the light translucent or transparent cover close to flush with the wall in the recessed night light box. The night light has an internal light bulb that may be easily replaced by removing a retaining screw at the top of the cover so that the bottom hinge mounted cover may be pivoted out and down to not only expose the bulb to be replaced but also automatically simultaneously disconnect the electric supply from the bulb socket and eliminate power from the bottom of the bulb in the socket for safety.

14 Claims, 6 Drawing Figures

Figure 1:
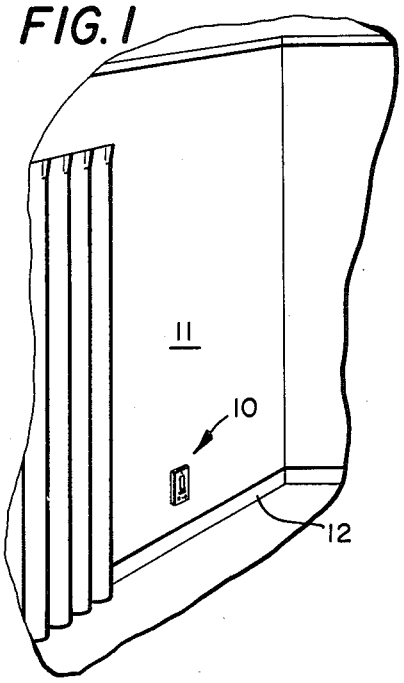

WALL RECEPTACLE RECESSED BOX CONTAINED LIGHT INTENSITY ON/OFF CONTROLLED NIGHT LIGHT SYSTEM

This invention relates in general to night lights, and more particularly, to an in the wall recessed night light with light intensity photocell on/off switch control and a hinged light transmitting cover structure that connects and disconnects the light to and from power as the cover is closed and opened.

Various receptacle plug-in night lights with removeable bulbs can be hazardous particularly in a child's environment. Such night lights can be easily broken by a child exposing hot circuits that may shock a child, or partially unplugged from the holding receptacle to also thereby create a shock hazard. Even adults at times will bump into such a night light protruding from the wall and at times create a shock hazard through damage to the night light and/or its mounting socket or partial withdrawal of a unit from a mounting plug in socket. Further, many night lights will take up the plug-in socket of a wall receptacle and if there is more than one plug-in socket in the wall receptacle obstruct the additional plug-in sockets from use. Some night lights with replaceable bulbs in bulb sockets present the hazard of possible shock if a finger enters the bulb socket when a bulb is being removed and replaced.

It is therefore a principal object of this invention to provide a night light safer to use than preexisting night lights.

Another object with such a night light is to reduce shock hazards especially in a child's environment.

A further object is to provide a wall recessed night light less subject to breakage damage than is the case with receptacle plug-in mounted night lights.

Still another object is to provide a wall flush night light with a pivotal light front that disconnects the light bulb from the electric circuit when the light front is pivoted open for bulb removal and replacement.

Features of the invention useful in accomplishing the above objects include, in a wall receptacle recessed box contained light intensity on/off controlled night light system, a photocell light intensity dusk-dawn (or room illumination) on/off switch with manual dimming control for a darker/brighter night light atmosphere. The night light box is insertable in a recessed box in the wall otherwise used for a normal receptacle outlet and includes at least one plug in receptacle with the light translucent or transparent cover close to being flush with the wall in the recessed night light box. The night light has an internal light bulb that may be easily replaced by removing a retaining screw at the top of the cover so that the bottom hinge mounted cover may be pivoted out and down to not only expose the bulb to be replaced but also automatically simultaneously disconnecting the electric supply from the bulb and the bulb socket and to eliminate power from the bottom of the bulb in the socket for safety.

Specific embodiments representing what are presently regarded as the best modes of carrying out the invention are illustrated in the accompanying drawings.

Figure 2:
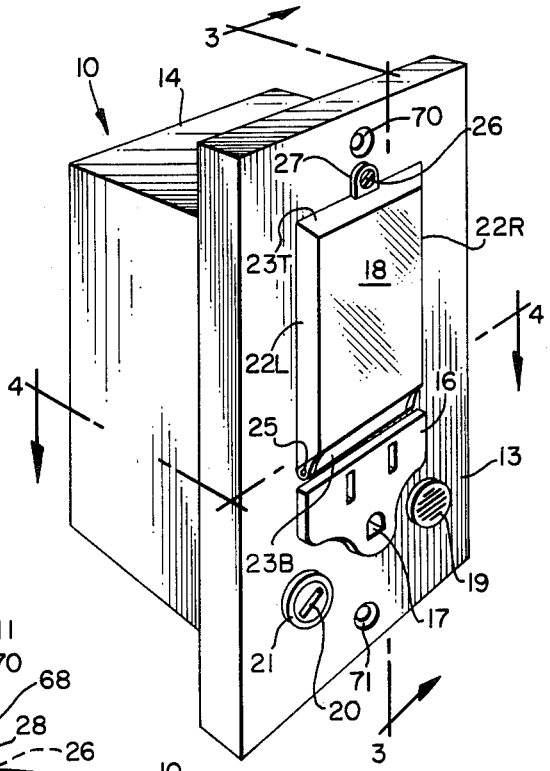
Figure 3:
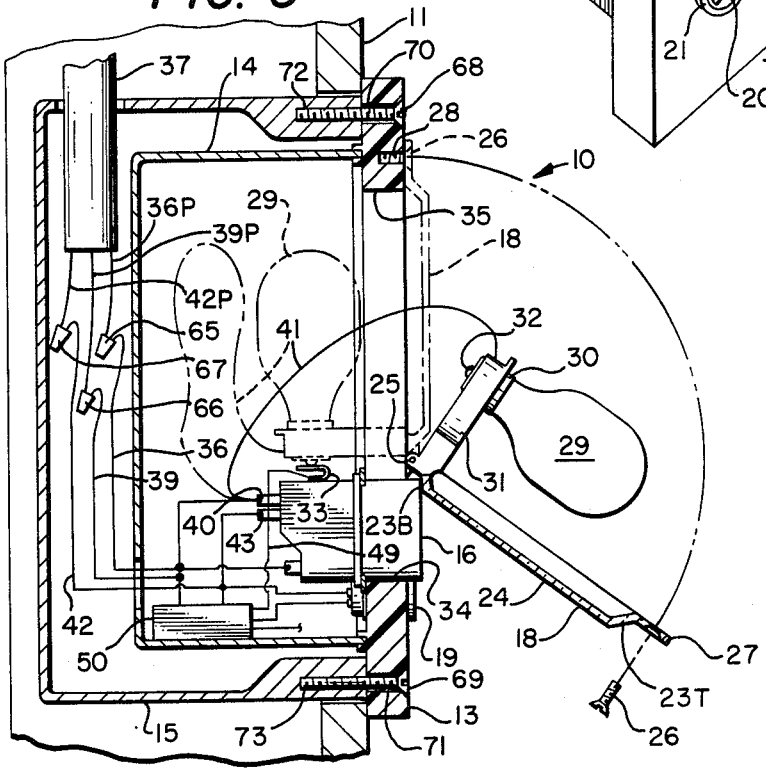
Figure 4:
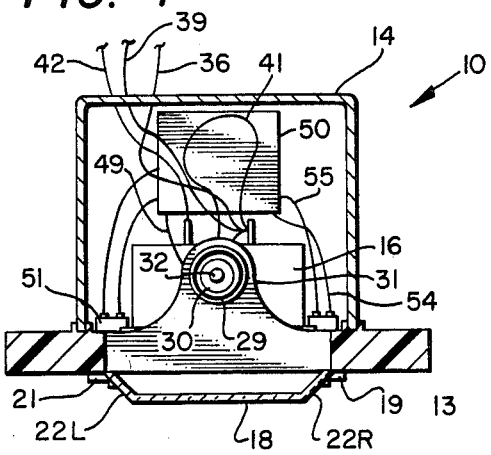
Figure 5:
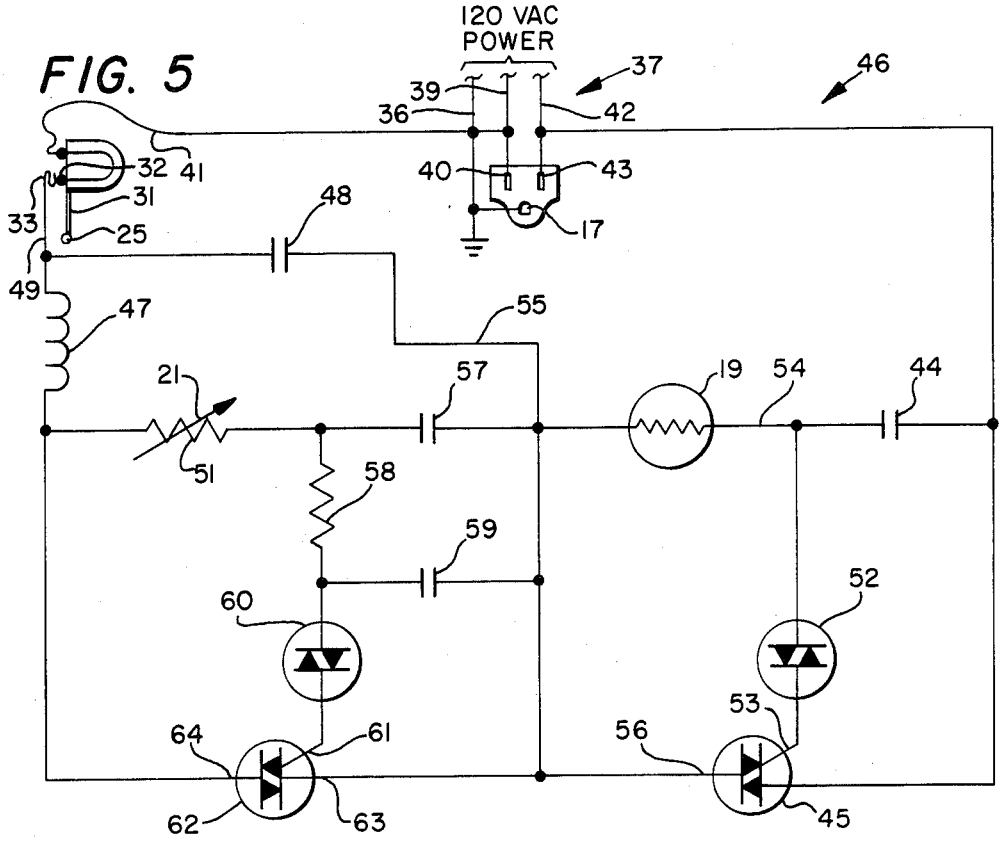

In the drawings:

FIG. 1 represents a perspective view of the corner of a room showing a wall recessed receptacle box contained night light above a baseboard;

FIG. 2, a perspective view of the night light of FIG. 1 removed from the receptacle box;

FIG. 3, a side elevation cut away and sectioned view taken along line 3—3 of FIG. 2 showing detail of the night light as mounted in a wall receptacle box;

FIG. 4, a top plan cut away and sectioned view taken along line 4—4 of FIG. 2 showing internal wiring detail of the night light box of FIG. 2;

FIG. 5, a schematic of the night light box circuitry; and

Figure 6:
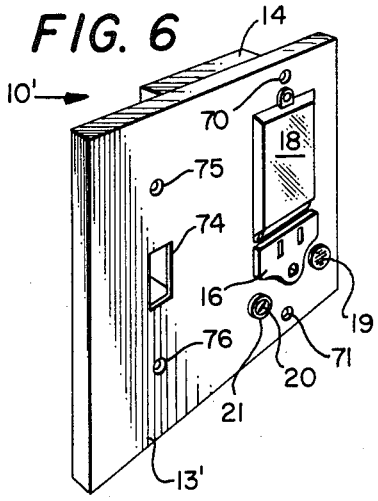

FIG. 6, a perspective view of a double plate version of the night light box mountable on a wall with the night light circuit box receivable in a receptacle box.

Referring to the drawings:

The wall recessed night light 10 is shown in FIG. 1 to be mounted low in a room wall 11 above a baseboard 12. Referring also to FIGS. 2, 3 and 4 the night light 10 is shown to have a face plate 13 replacing a conventional electrical wall receptacle face plate and an electronic circuit box 14 that is received within a conventional wall recessed receptacle box 15. The night light 10 while replacing most any one conventional 110 volt receptacle outlet in a home still provides one receptacle outlet 16 including a ground receptacle connection 17. The night light 10 that includes light transmitting rectangular cover 18 is an automatically controlled night light by means of photocell 19 for dusk-dawn on/off switching control and a manual screw driver slotted 20 potentiometer adjustment tap rod 21 accessable from the front of the night light face plate 13 provides manual dimming control for a darker/brighter night light atmosphere during night time hours when normal room illumination is turned off. Normally, the night light 10 will not function during daylight hours unless the room it is being used in becomes unusually dark for that time of day so it usually provides light for its owner (user) only at night when other artificial illumination is not being used in the room. Safety is an important consideration in night light 10 with, for example, the manual dimming control not being readily available to children in that a small screw driver is required for the slotted recessed rod marked "Dimmer" for turn adjustment to the desired brightness. The ground connection 17 with receptacle outlet 16 further enhances safety.

In order to further enhance safety the light transmitting cover 18, with its rectangular bevelled side edges 22L and 22R and top and bottom edges 23T and 23B, cover face 24 is pivotally mounted 25 at the bottom to pivot out and down from the top when cover restraining screw 26 extended through cover 18 top tabe 27 into opening 28 of face plate 13 is removed for opening of the light transmitting cover 18 to replace the light bulb 29. Light bulb 29 is mounted in a socket 30 provided therefore in the inwardly extended bulb mounting flange 31 that is part of and extends inwardly from the inside bottom of the structure of light transmitting cover 18 to mount a light bulb 29 thereon. The cover 18 structure is such that the bottom contact 32 of light bulb 29 is lifted up and away from resiliently flexible spring metal contact 33 mounted on, and to extend upward from the receptacle outlet 16 extending through opening 34 in a face plate 13, and extending to the rear for the three line 120 volt power supply line connections thereto. This pivoting movement not only lifts the light bulb 29 up and away from the electric power contact 33 but forward and out through the opening 35 in the face plate 13 for easy safe accessability in changing bulb 29.

Referring also to FIG. 5 the ground wire 36 of the 120 volt A.C. power line 37, that is shown entering receptacle box 15 through opening 38, is connected to receptacle ground connection 17 and also the left side (in FIG. 5) 120 volt A.C. power line wire 39 as the common to the left side of receptacle outlet 16 via terminal 40. Ground and power line common wire 39 is also connected from terminal 40 via flexible insulated jumper wire 41 to bulb socket 30 establishing electrical power circuit ground contact to the socket 30 for bulb 29. The right side 120 volt A.C. power line wire 42 is connected directly to the right side of receptacle outlet 16 via terminal 43 and also to the junction of capacitor 44 and Triac 45 in night light control circuit 46. The outlet junction between coil 47 and capacitor 48 of control circuit 46 is connected by line 49 to the spring metal contact 33 and thereby bulb bottom contact 32 during normal operation of the night light 10. The flexible insulated wire 41 has to be flexible and of sufficient length to accomodate movement of socket 30 with the lifting and away movement of socket 30 with bulb 29 when the light transmitting cover 18 structure is pivoted open. Night light control circuit 46 that may be primarily a circuit board circuit 50 (or solid state circuit) has connections to photocell 19 and to potentiometer 51 with the screw driver slotted 20 adjustment tap rod 21 mounted on and extending through to the outer face of face plate 13. This is with capacitor 44 connected through Diac 52 to the biasing electrode 53 of Triac 45 within circuit board circuit and also through line 54 to photocell 19 the other side of which is connected through line 55 to and through capacitor 48 to line 49. Electrode 56 of Triac 45 is also connected to line 55 and in parallel with photocell 19 through capacitor 57 to the junction of resistor 58 and potentiometer 51, and also through capacitor 59 to the junction of resistor 58 and Diac 60 the other electrode of which is connected to the biasing electrode 61 of Triac 62. The electrode 56 of Triac 45 is also directly connected to electrode 63 of Triac 62 and the electrode 64 thereof is connected to the junction of coil 47 and potentiometer 51. Potentiometer 51 is adjustable to vary power to bulb terminal 32 thereby providing a dimming adjustment to a night light illumination intensity desired and coil 47 stabilizes power feed to avoid night light on/off flicker.

The three power input wires 36, 39 and 42 of night light 10 are connected to 120 volt A.C. power line 37 wires 36P, 39P and 42P via twisted wire connections within twisted wire screw on covers 65, 66 and 67. The night light 10 is mounted on a conventional wall recessed receptacle box 15 with screws 68 and 69 extended through face plate 13 openings 70 and 71 into receptacle box 15 threaded openings 72 and 73.

With the double face plate 13' night light 10' embodiment of FIG. 6 everything-night light circuit, component and operation is the same as with the night light 10 of FIGS. 1–5 except that face plate 13' is a double face plate wth provision of a power switch opening 74 and additional mounting screw openings 75 and 76 in the side extension portion of the double face plate 13'.

Whereas this invention has been described with respect to several embodiments thereof, it should be realized that various changes may be made without departure from the essential contributions to the art made by the teachings hereof.

I claim:

1. A wall receptacle recessed box light intensity on/-off controlled night light comprising: a night light with night light bulb and control circuitry contained in a night light box receivable in a wall receptacle recessed box in its operational state; a face plate covering the opening in the wall of the wall receptacle receiving said night light box; a light transmitting cover mounted on said face plate and enclosing an opening in said face plate; a photocell for dusk/dawn on/off switching control of said night light-box mounted in said face plate for sensing the intensity of light impinging on said face plate; signal intensity trigger circuit means responsive to the electrical signal generated by said photocell for on/off switching control of power to said night light bulb; and power supply means connected to said signal intensity trigger circuit means; wherein said face plate is fastened to a wall by screw fastening means; said light transmitting cover is part of a cover structure pivotally mounted on the bottom to said face plate and fastened to the face plate at the top by screw fastening means in the closed state; an inwardly extended flange, including a bulb socket thereon extending inwardly from and a part of said cover structure to mount a light bulb thereon such that the bulb is lifted up and out through the opening in said face plate when said light transmitting cover with said cover structure is pivoted to the open state when said screw fastening means is removed from the face plate; and wherein said socket for said light bulb is connected to common-ground; and a metal contact mounted in said night light box positioned to be engaged by the bottom contact of said light bulb when the light bulb is pivoted down to the operational position when said light transmitting cover with said cover structure is pivoted to the closed state.

2. The wall receptacle recessed box light intensity on/off controlled night light of claim 1, wherein hot circuit line means is connected from said power supply through said control circuitry to said metal contact.

3. The wall receptable recessed box light intensity on/off controlled night light of claim 2, wherein said metal contact is a resiliently flexible spring metal contact.

4. The wall receptacle recessed box light intensity on/off controlled night light of claim 3, wherein said night light box includes a receptacle power outlet socket having a body mounted on, extending through to the front of said face plate, and extending through to rear from said face plate.

5. The wall receptacle recessed box light intensity on/off controlled night light of claim 4, wherein said receptacle power outlet socket is mounted in said face plate below said light transmitting cover structure.

6. The wall receptacle recessed box light intensity on/off controlled night light of claim 5, wherein the top of the body extending to rear from said face plate is a mount for said metal contact.

7. The wall receptacle recessed box light intensity on/off controlled night light of claim 6, wherein said control circuitry includes a potentiometer dimming control for darker/brighter night light atmosphere during night time hours when normal room illumination is turned off.

8. The wall receptacle recessed box light intensity on/off controlled night light of claim 7, wherein said potentiometer is mounted on said face plate with the potentiometer tap adjustment means accessable for setting from the front of said face plate.

9. The wall receptacle recessed box light intensity on/off controlled night light of claim 8, wherein said bulb socket is a threaded metal socket mounted in said inwardly extended flange.

10. The wall receptacle recessed box light intensity on/off controlled night light of claim 9, wherein connection of said bulb socket to common ground includes a loop of flexible insulated electric wire of sufficient length to accommodate movement of said bulb socket through the range of pivoted movement thereof with movement of said inwardly extended flange with pivoted opening and closing of said cover structure for bulb changes.

11. The wall receptacle recessed box light intensity on/off controlled night light of claim 10, wherein most of said night light structure is contained behind the front face of said face plate with said light transmitting cover extended forward from the front face of said face plate to a very small extent as related to the width and heighth thereof.

12. The wall receptacle recessed box light intensity on/off controlled night light of claim 11, wherein said light transmitting cover is rectangular in shape with bevel sloped edges.

13. The wall receptacle recessed box light intensity on/off controlled night light of claim 12, wherein said face plate is extended laterally to the extent of forming a double face plate mountable on a wall and supporting additional control means.

14. The wall receptacle recessed box light intensity on/off controlled night light of claim 5, wherein said receptacle power outlet socket is a three prong plug socket.

* * * * *